United States Patent [19]

Maloney

[11] Patent Number: 4,540,089

[45] Date of Patent: Sep. 10, 1985

[54] BAG AND BAG MAKING APPARATUS

[75] Inventor: John Maloney, Alsager, England

[73] Assignee: Johnsen & Jorgensen Jaypak Limited, London, England

[21] Appl. No.: 444,899

[22] PCT Filed: Mar. 10, 1982

[86] PCT No.: PCT/GB82/00082

§ 371 Date: Nov. 18, 1982

§ 102(e) Date: Nov. 18, 1982

[87] PCT Pub. No.: WO82/03208

PCT Pub. Date: Sep. 30, 1982

[30] Foreign Application Priority Data

Mar. 18, 1981 [GB] United Kingdom ..... 8108402
Jul. 11, 1981 [GB] United Kingdom ..... 8121451

[51] Int. Cl.[3] ..... B65D 25/08

[52] U.S. Cl. ..... 206/219; 383/38; 383/40

[58] Field of Search..... 206/216, 219, 221, 620, 383/38, 98, 125, 40, 109, 111, 88

[56] References Cited

U.S. PATENT DOCUMENTS

| | | | |
|---|---|---|---|
| 2,800,269 | 7/1957 | Smith | 206/219 |
| 2,899,318 | 8/1959 | Long | 206/219 |
| 3,343,664 | 9/1967 | Poitras | 206/219 |
| 3,419,258 | 12/1968 | Ritchie | 206/219 |
| 3,460,741 | 8/1969 | Kugler | 583/38 |
| 3,543,999 | 12/1970 | Kugler | 383/38 |
| 3,608,709 | 9/1971 | Pike | 206/219 |
| 3,917,160 | 11/1975 | Olerud | 383/111 |
| 3,967,728 | 7/1976 | Gorden et al. | 206/484 |
| 4,057,047 | 11/1977 | Gossett | 206/219 |
| 4,106,478 | 8/1978 | Higashijima | 206/219 |
| 4,226,330 | 10/1980 | Butler | 206/219 |
| 4,256,256 | 3/1981 | Meyers | 383/40 |
| 4,314,558 | 2/1982 | Korpman | 383/88 |
| 4,411,358 | 10/1983 | Bennwik et al. | 383/38 |

*Primary Examiner*—Joseph Man-Fu Moy
*Assistant Examiner*—David T. Fidei
*Attorney, Agent, or Firm*—Neil F. Markva

[57] ABSTRACT

A mixing bag (4) comprising a mixing chamber in the form of a compartment (45), a pocket (42) in the bag having a mouth opening (44) so that it can be filled with liquid (72) to a predetermined volume. The pocket is easily ruptured when the mouth is closed to discharge the volume of liquid into the compartment for mixing with a material (70) in the compartment. During mixing the walls (46, 47) of the pocket about to serve as a non-return valve in the bag.

23 Claims, 8 Drawing Figures

BAG AND BAG MAKING APPARATUS

TECHNICAL FIELD

This invention concerns the packaging of materials which are to be mixed with a liquid to form a mixture. Many such materials are known, e.g. dry mortar in pulverulent form, plaster powder, and food or beverage making mixture such as a cake mixture, and such material is hereinafter referred to as "a material for mixing".

BACKGROUND ART

The mixing of such a material with a liquid is often a messy proceeding, involves the subsequent cleaning of the surface or receptacle and the implement used to perform the mixing, and sometimes involves the risk of spillage of the material or mixture causing damage; and an object of the invention is to enable these disadvantages to be reduced or obviated.

Furthermore, the mixing of such a material with a liquid usually requires a predetermined or selected amount of the material to be mixed with a predetermined or proportionate amount of liquid, the latter, at least, having to be measured by the user. The measuring operation is often inconvenient to perform and is sometimes omitted by persons who estimate or guess the amount of liquid to the possible detriment of the performance of the mixture produced, and an object of the invention is to enable this inconvenience to be reduced or obviated.

DISCLOSURE OF INVENTION

According to the present invention there is provided a bag containing material for mixing within the bag, wherein the bag is formed from flexible waterproof film material so that there are within the bag a compartment and a pocket, the material for mixing being contained within the compartment; characterised in that (a) the bag is provided with a mouth which serves as an opening for insertion of liquid into the pocket;
(b) the pocket has opposed walls and is interposed between the compartment and the mouth to provide a seal therebetween;
(c) the pocket is adapted to hold a predetermined quantity of liquid so as to serve as a measure, and at least a portion of the pocket is frangible to allow the pocket to be ruptured to discharge measured liquid into the compartment, and in that
(d) said opposed walls are adapted to abut after rupture of the pocket to serve as a non-return valve obstructing the passage of liquid and material to the mouth, so as to permit the bag to retain the contents during mixing thereof by manipulation of the bag.

The provision of the pocket enables liquid to be measured easily, and provides means for carrying the liquid from the point of supply to the place whereat the liquid material are to be mixed and the mixture used. Furthermore, the pocket serves, before being ruptured, as a seal between the mouth and the interior of the bag, to exclude atmospheric moisture from said material.

According to the present invention there is also provided apparatus, for making bags, comprising feeding means and bonding means, the feeding means being arranged to feed a plurality of films of waterproof thermoplastics material through the bonding means, and the latter being arranged to form bonds between said films, wherein the bonding means comprises confronting members disposed at opposite sides of a web transit path therebetween, which members are mounted so that the spacing therebetween can be varied to cause the members to abut webs of said films located in said web transit path, the apparatus being characterised in that a web separator member is provided in said web transit path between at least portions of two of said confronting members to separate portions of adjacent webs to prevent bonds being made to those surfaces of said portions which abut the web separator whilst allowing bonds to be made to the other surfaces of said portions at each side of the web separator by said at least two portions for forming mouths for the bags.

The present invention also provides a method of making bags from films of thermoplastic material, wherein a plurality of webs of said films are superimposed upon each other and are fed along a web transit path between confronting members of bonding means, characterised in that portions of adjacent webs are spaced apart to prevent bonds being made between said spaced apart portions of two of said webs as said bonding means is actuated to form bonds between said portions of said webs and others of said webs.

The bag is preferably formed so that the walls of said pocket are formed from a single membrane disposed between opposed outer walls of the bag so as to project into the compartment, and said single membrane is preferably of a material which is thinner than the material from which the outer walls are formed. This form of bag has given highly satisfactory results under test conditions and is very convenient to manufacture upon the apparatus of the invention.

For making the aforementioned preferred bags the apparatus is preferably adapted so as:

(a) to unroll two sheets of relatively robust plastics film and to unroll a lay-flat tube of a relative frangible plastics film;
(b) to feed said films to slitting means so that the tube is sandwiched centrally between the sheets and so that the sandwich of sheet and tube is slit longitudinally to form two separate runs in each of which one half of the tube constitutes an intermediate film which is folded to give two abutting intermediate webs disposed between two outer webs of the sheet film;
(c) to separate portions of said abutting intermediate webs and to form a predetermined seam between each said portion and an abutting portion of the adjacent web of relatively robust sheet film, for forming the mouths of the bags; and
(d) to form further seams between said webs to form bags having open ends defined between confronting portions of said webs of relatively robust film, for use as material insertion openings for admitting contents into compartments in the bags prior to the closure of said open ends to close said compartments.

Said further seams are preferably formed so that each bag is made in two stages, at least some of the seams lying, in the direction of movement of the webs, downstream of the predetermined seam being formed first, and then the remaining seams being formed after the run has been advanced to move said predetermined seam from the separator.

The separator preferably comprises a fixed support disposed between the runs so as to locate a planar heat resistance member in a position in which it extends into each half of said tube.

The members preferably each include an array of heating elements, and one element of each array is preferably easily positionally adjustable so that the position of a seam made by said adjustable elements can be varied relative to said predetermined seam, for making a preferred form of the bag wherein the volume of said pocket is restricted by a seam separating a usable portion of the pocket from a closed and unfillable portion.

The invention includes bags made by the apparatus or method of the invention.

The invention will be described further, by way of example, with reference to the accompanying diagrammatic drawings, wherein:

BEST MODE FOR CARRYING OUT THE INVENTION

Figure 1:
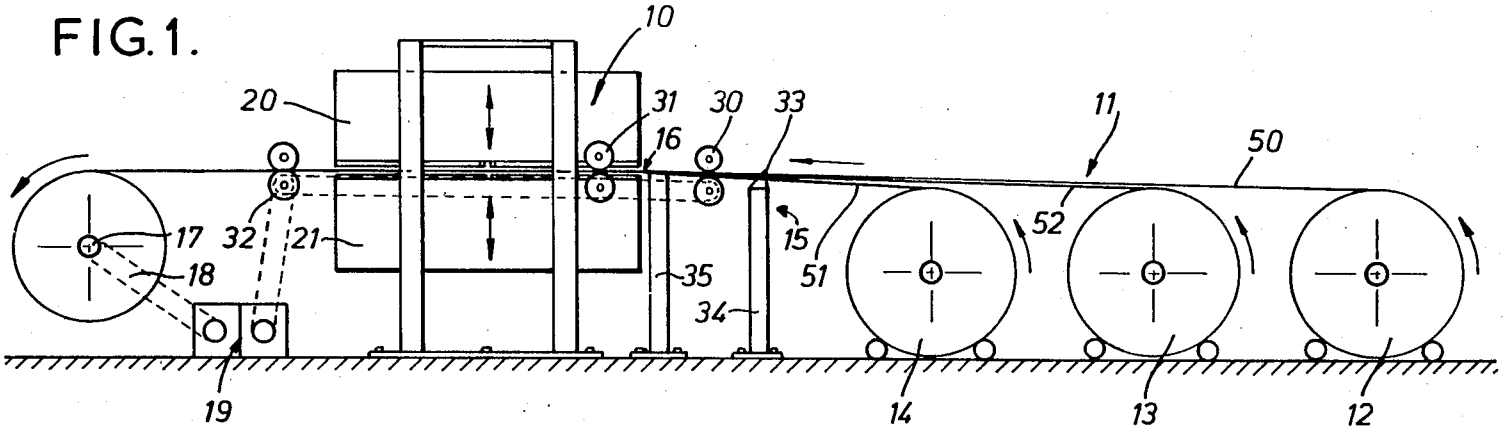
FIG. 1 shows a schematic layout of apparatus according to the invention.
Figure 4:
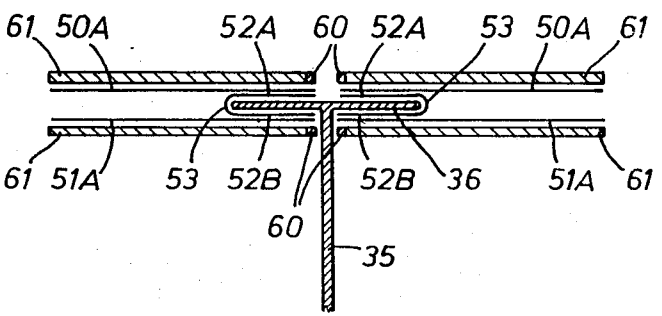
FIGS. 2, 3 and 4 are part sectional views showing portions of the apparatus respectively in plan, side and front elevation.

The apparatus comprises web bonding means 10, feeding means 11 to feed films of waterproof thermoplastics material from rolls 12, 13 and 14 to the bonding means, via web splitting means 15 and a separator 16, and take up means 17 to wind bags onto rolls 18.

The bonding means 10 comprises upper and lower relatively movable members 20 and 21, which members are mounted respectively above and below a web transit path therebetween, and which members incorporate perforators 22 and sets of heating elements, which sets confront each other across the web transit path. At least one of said members 20, 21 is movably mounted so that the sets can be moved together and apart to vary the spacing therebetween and thus to vary the thickness of the web transit path.

The feeding means 11 includes first, second and third pairs of driven or nip rollers 30, 31 and 32 to draw the films along the web transit path, and drive means 19 to drive said rollers in unison and to rotate the rolls 12, 13, 14 and 18.

The web splitting means 15 comprises a fixed knife 33 which is mounted on a support 34 so as to bisect the films longitudinally into webs as the film material is fed to the knife, and a further support 35 carries a cross-piece 36 to which the separator 16 is attached. The latter is a strip of plastics material, such as P.T.F.E., having a relatively high melting point, or is of thin metal.

Figure 5:
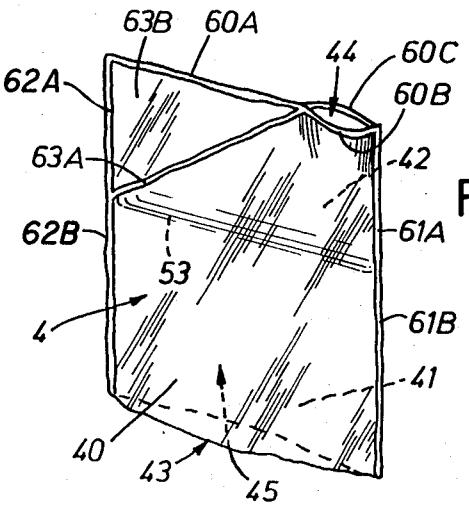
FIG. 5 is a perspective view of a bag of the invention formed by the apparatus.

Referring to FIG. 5, the bag 4 comprises two outer walls 40 and 41 and an internal pocket 42. The bottom 43 of the bag is left open and a mouth 44, which opens into the pocket 42, is left open at the top of the bag.

The bags are formed from an upper film 50 and a lower film 51 of a relatively robust sheet plastics drawn from the rolls 12 and 14, and an intermediate lay-flat tube 52 of a relatively frangible plastics film material drawn from the roll 13. The films 50, 51 with the flat tube 52 sandwiched therebetween are drawn by the rollers 30 to the knife 33 so that the sandwich is split longitudinally into two symmetrical runs of webs.

Figure 2:
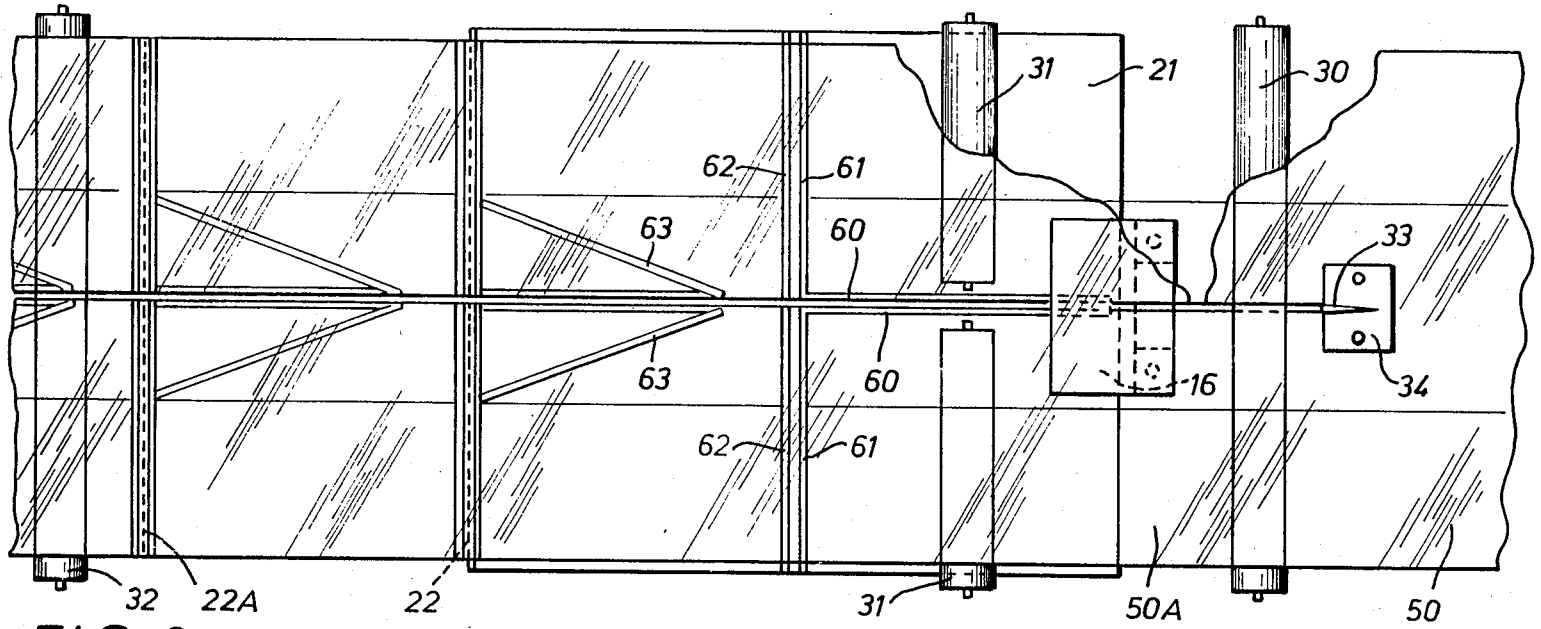
Figure 3:
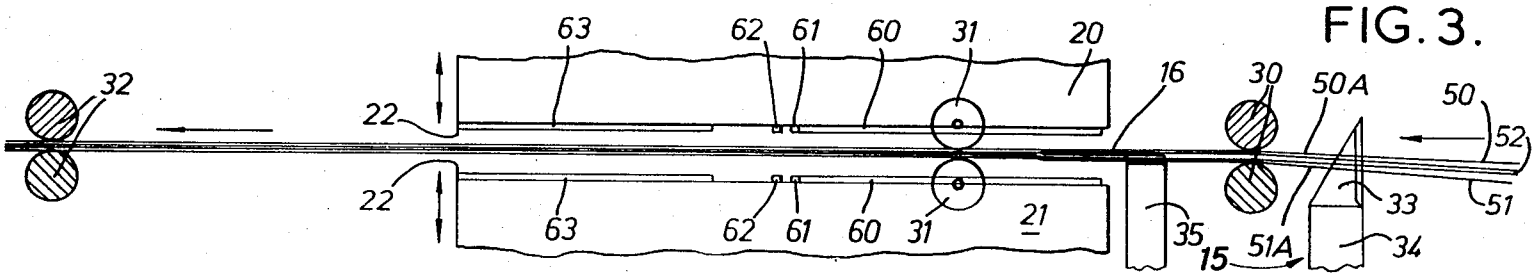

In each run there is an upper web 50A and a lower web 51A with one half of the tube 52 therebetween. Said half of the tube provides a single membrane folded to provide an upper intermediate web 52A and a lower intermediate web 52B each of lesser width than the webs 50A and 51A, and provides a junction fold 53 between said webs 52A and 52B, which junction 53 provides bottoms for the pockets 42. Said webs 50A, 51A, 52A and 52B abut to form a sandwich, and are drawn by the rollers 31 across the separator 16 so that the latter separates the webs 52A and 52B as they enter the bonding means. As shown in FIGS. 2 and 3, the separator 16 extends into the web transit path between the members 20 and 21 so as to hold apart portions of the webs 52A and 52B as said webs enter the path between said members.

Each set of elements comprises two similar arrays which are symmetrical about a longitudinal center line of the web transit path, which longitudinal center line is disposed between the two runs, the latter being guided by the rollers 31 and 32 so that the edges of the webs formed by the knife 33 are parallel to said longitudinal center line.

Each array confronts a complementary array on the other member to form a pair, and comprises a first element 60 parallel to the center line, closely parallel second and third elements 61 and 62 perpendicular to the center line, and a fourth element 63.

In each pair of arrays the first elements 60 cooperate to form a top seam of the bag, which top seam comprises a first portion 60A which joins all four webs together and two portions 60B and 60C which, during formation, are separated by the separator 16, so that the portion 60B joins the top web 50A to the web 52A, and the portion 60C joins the bottom web 51A to the web 52B. The second elements 61 cooperate to form a first side seam of the bag which side seam comprises first portion 62A which extends from the top seam to the junction 53 to join together all four webs, and a second portion 62B which extends from the junction 53 to the bottom of the bag.

The drive means is arranged to drive the webs incrementally in steps of substantially one bag width, so that the top 60A and first side seams 62A, 62B are formed first for each bag by feeding the webs between the said members, closing the members together to nip the webs between heating the elements, and, when the elements have cooled to allow the seams to set, advancing the webs to bring the partly formed bags therebetween the third and fourth elements.

The third elements 62 of each pair cooperate to form the second side seam 61A and 61B which extends from the mouth to the bottom of the bag; and the fourth elements 63 from a diagonal seam 63A which extends across a top corner portion 63B of the bag so that said portion 63B serves as a handle and is sealed from the pocket and the remainder of the interior of the bag.

The perforators 22 are disposed to make a line of perforations 22A between the second seam 16A, 61B of a finished bag and the first side seam 62A, 62B of the next adjacent bag as the members 20 and 21 are closed to form the second and diagonal seams of the latter bag.

The so formed bags are connected by the perforated portions therebetween and are wound gently onto the roll 18.

When full, the rolls 18 of bags are taken to a known form of bag filling apparatus (not shown) wherein the bags are inverted and have measured amounts of a material (70 - FIGS. 6 to 8) for mixing inserted into the compartments 45 via the open bottoms 43; and thereafter the bottoms 43 are closed by a seaming device (not shown) which forms bottom seams 65 (FIGS. 6 and 8) to seal the compartments with the material 70 therein. The individual filled bags may be detached from one another and suitably packaged for sale.

Figure 6:
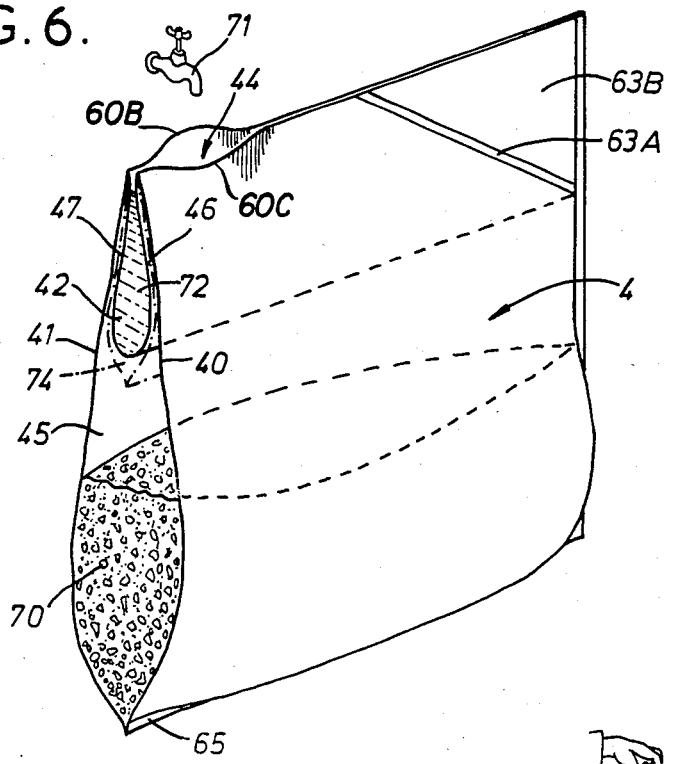
FIG. 6 is a part sectional perspective view of the bag being used as a liquid measure.

The bag 4, shown in FIGS. 5 to 8 comprises the two main outer walls 40 and 41 secured together along the sides and the top of the bag as described to define a main compartment 45 therebetween; two internal webs 46 and 47 which are secured together by the means 60A, 61A, 62A and 63A. The walls 46 and 47 extend into the main compartment 45 from the top of the bag and are joined together by the fold 53 to form the pocket 42 therebetween. Along the top of the bag the wall 46 is joined to the adjacent wall 40 and similarly the wall 47 is joined to the wall 41, and the walls 46 and 47 are secured together along most but not all of the top of the bag so as to leave portions 60B, 60C defining the mouth 44 which opens into the pocket 42. The walls 46 and 47 normally lie in a flat condition in face to face abutting relationship, but the portions 60B, 60C are shown spaced apart in FIG. 6 to show the mouth 44 in an open condition ready to admit liquid to the pocket, e.g. from a tap 71. The pocket 42 serves as a measure for measuring a predetermined volume of the liquid 72 for mixing with the predetermined amount of the material 70. The diagonal seam 63A restricts the capacity of the pocket 42 so that, when filled to its restricted capacity, the pocket holds said predetermined volume. However, the seam 63A may be omitted and markings, not shown, may be printed on the bag, to indicate a particular level to which the pocket is to be filled with liquid 72, for measuring the liquid. The pocket is filled in the horizontal condition with the liquid 72, as shown in FIG. 6.

Figure 7:
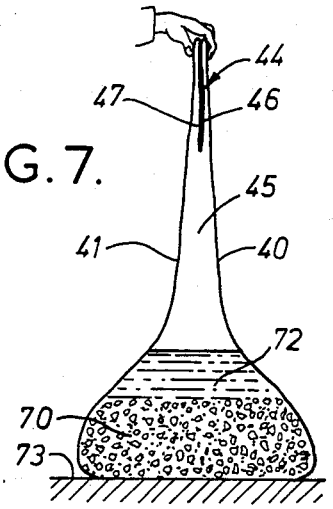
FIGS. 7 and 8 are sectional views showing the bag resting vertically and horizontally upon a surface prior to mixing of the liquid with a material contained in the bag.
Figure 8:
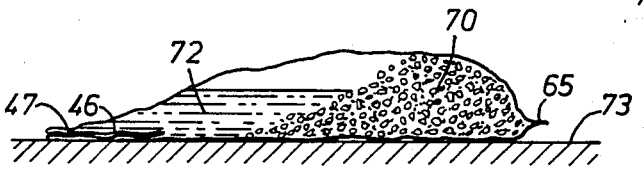

After the pocket has been filled, the mouth is closed, (e.g. by being held manually or by clamp or sealing means, or by the walls adjacent the mouth being doubled over or folded and held) and the pocket is burst or is ruptured by striking or thrusting inwards the main walls 40, 41 abutting the internal pocket walls 46, 47, to discharge the liquid from the pocket into the main compartment 45. When the liquid is discharged from the pocket, the walls 46, 47 assume a face to face abutting relationship and are held together by a thin film of the liquid as shown in FIGS. 7 and 8. In this condition the walls 46, 47 serve as a non-return valve between the main compartment and the mouth, so that the mouth can be released and the bag stood (FIG. 7) or laid on a supporting surface 73 as shown in FIG. 8, the walls 46, 47 being further held together by the bulk of material and liquid. The contents can then be mixed by manipulating the bag to form a mixture, and thereafter the bag can be opened to enable the mixture to be used.

The invention affords several advantages including:

(a) The liquid can be inserted into the pocket at a point and time of availability of the liquid, and can be held in the bag until the mixture is required for use.

(b) Where a mixture, such as custard, has to be mixed in two stages, the pocket can be used to measure a small first quantity of liquid, which is then mixed with the material, and then the compartment can be used as a measure for a final quantity of liquid which can be inserted via the mouth and pocket into the compartment and thereafter mixed with the mixture, because air will be trapped at the top of the compartment to ensure that the walls 46, 47 abut and to leave room for mixing without overstressing the walls of the bag.

(c) The user is protected from harmful or irritating dust or fumes usually caused by mixing dry materials with liquids.

(d) The mixture can be produced (without inconvenience, spillage or the use of mixing utensils) within the bag so as to be free from contamination.

(e) The mixture is protected by the bag, e.g. to prevent evaporation of the liquid.

(f) A corner can be cut from the bag to enable the mixture to be extruded e.g. into a slot, recess or cavity to be filled.

(g) Surplus material can be left in the bag for convenient disposal.

(h) The producer of the package can fill the bag using known filling methods, but may omit the usual preliminary dry mixing or blending of the ingredients forming the material for mixing.

(i) A second material for mixing may be inserted in the pocket, e.g. a material which has to be kept apart from the material in the main compartment until the mixture is to be made, and said second material may be pre-mixed with the liquid prior to the pocket being ruptured.

The invention is not confined to the precise details of the foregoing examples and many variations are possible within the scope of the invention. For instance, the shape, size and form of the bag may be varied.

The pocket is preferably made from a folded single membrane of weaker material then the main walls of the bag, so as to rupture easily, but the pocket walls may be made from individual films or webs with a frangible bond being provided between the lower margins of the pocket walls to form an easily ruptured weak seam.

The size, shape and disposition of the mouth can be varied as desired. For instance, in a vertically elongate bag, the mouth may extend substantially across the top of the bag. The mouth may be extended vertically to provide easily separable flaps or to form an inlet conduit which can be easily clamped shut or even tied in a knot to close the mouth, especially if a second material for mixing is accommodated in the pocket.

The pocket 45 may be an inner pocket located in a larger supplementary thin walled frangible pocket 74, which supplementary pocket 74 may have a side opening which is closed by a side seam after insertion of a second material for mixing.

The heating elements may be of electrical resistance or ultrasonic or high frequency welding form, and may be arranged as desired to provide bags or any suitable shape or size having open bottoms, or closed bottoms and partially open sides, for filling.

The arrays in each set, the separator, the splitter and the feeding means may be adapted to form bags of a first size or shape from one of the runs, and bags of a different size or shape from the other of the runs, subject to the limitations imposed by the need to advance the two runs of webs at a common overall rate. Alternatively a pre-arranged single run of webs may be employed and fed to bonding means comprising one pair of arrays.

Any suitable form of splitter may be employed, e.g. a moving blade, and the separator may be made of any suitable material.

The elements are detachable and may be relocated or replaced by other elements to produce other sizes and/or shapes of bags. In particular the fourth elements 63 may be easily movable or rendered inoperative to vary the position of or to omit the pocket volume limiting seams 63A.

The apparatus may include trimmers to trim or remove superfluous material from the bags.

I claim:

1. A composite bag having an outer periphery including a top, bottom and two sides and being formed from flexible waterproof material, said bag comprising:

(a) opposed outer walls forming an outer compartment and opposed inner walls forming an inner pocket which is disposed within the outer compartment, (b) the opposed inner walls being joined along the entire length thereof to the opposed outer walls forming a hermetically tight joint therealong to seal the inner pocket from the outer compartment, (c) the opposed outer walls being bonded together along the outer periphery thereof to form the outer compartment except for a shortened bonded section effective to form an open mouth leading to the inside of the inner pocket for receiving liquid (matter) therein, (d) the bonded outer periphery further including a material insertion opening along a portion of the outer periphery other than the top of the bag, (e) the material insertion opening being effective to be sealed after material has been inserted into the outer compartment through said insertion opening, (f) a portion of the inner pocket being frangible to allow the pocket to be ruptured by manual pressure to discharge the liquid from the inner pocket into the outer compartment after the material insertion opening has been sealed to mix the contents therein with the liquid, (g) the combination of said pocket, outer compartment and open mouth being effective to allow the pocket to remain empty and open to receive a measured amount of liquid fed through the open mouth by the user just before the time of rupture for effecting mixing between the liquid and material in the outer compartment, (h) the opposed inner walls forming the pocket are adapted to assume a face-to-face abutting relationship when the liquid has been discharged from the pocket into the outer compartment after rupture of the pocket so that the abutting faces are in a self-sealing position whereby the abutting faces serve as a non-return valve obstructing the passage of liquid and material to the open mouth, thereby retaining the contents during the mixing thereof by manipulation of the bag.

2. A composite bag as defined in claim 1 wherein the opposed inner walls are joined to the opposed outer walls by bonding.

3. A composite bag as defined in claim 2 wherein the bonding comprises a heat seal.

4. A composite bag as defined in claim 1 wherein the opposed inner walls extend along the entire length of the top of the bag.

5. A composite bag as defined in claim 4 wherein the inner walls have end portions that are coextensive with the two sides of the outer periphery.

6. A composite bag as defined in claim 1 wherein the open mouth leading to the inner pocket is located along the top of the outer periphery.

7. A composite bag as defined in claim 1 wherein the material insertion opening is located along the bottom of the outer periphery.

8. A composite bag as defined in claim 1 wherein the material insertion opening is defined by leaving a portion of the outer walls along the outer periphery unbonded so that material may be inserted into the compartment therethrough after which said unbonded portion can be sealed.

9. A composite bag as defined in claim 1 wherein the inner pocket formed is adapted to hold a predetermined quantity of liquid.

10. A composite bag as defined in claim 9 wherein the inner pocket includes a restricting seam means to separate a usable, fillable portion of the pocket from a closed, unfillable portion of the pocket.

11. A composite bag as defined in claim 10 wherein the flexible, waterproof film material is thermoplastic, and the restricting seam means comprises a heat sealed portion extending from the top of the bag transversely across the inner pocket.

12. A composite bag as defined in claim 1 wherein the walls of the inner pocket are formed from a single membrane of said flexible film material and the single membrane is disposed between the opposed outer walls so as to project into the compartment.

13. A composite bag as defined in claim 12 wherein the single membrane, waterproof film material has a thickness that is thinner than the thickness of the flexible, waterproof film material which forms the outer walls of the compartment.

14. A composite bag as defined in claim 1 wherein the inner pocket includes a first pocket means located in a second pocket means that is larger than the first pocket means to form a double pocket arrangement, both the first and second pocket means being frangible.

15. A composite bag having an outer periphery including a top, bottom and two sides and being formed from flexible waterproof film material, said bag comprising:

(a) opposed outer walls forming an outer compartment and opposed inner walls forming an inner pocket which is disposed within the outer compartment, (b) the opposed inner walls being interposed between the outer walls of the compartment and being joined along their entire length thereof to respective said opposed outer walls to prevent material from entering the inner pocket from the outer compartment, (c) the opposed outer walls being bonded together along the outer periphery thereof to form the outer compartment except for a shortened bonded section effective to form an open mouth leading to the inside of the inner pocket for receiving liquid therein, (d) mixing material disposed in the compartment with the outer periphery being sealed to form a completed package ready for transportation and storage before any liquid is placed in the inner pocket, (e) a portion of the inner pocket being frangible so that when the ultimate user puts liquid matter into the inner pocket, the pocket may be ruptured by manual pressure to discharge said liquid matter into the mixing material of the outer compartment to form a mixture therewith, (f) the combination of said pocket, outer compartment and open mouth being effective to allow the pocket to remain empty and open to receive a measured amount of liquid fed through the open mouth by the user just before the time of rupture for effecting mixing between the liquid and material in the outer compartment.

16. A composite bag as defined in claim 15 wherein the opposed inner walls forming the pocket are adapted to assume a face-to-face abutting relationship when the liquid has been discharged from the pocket into the outer compartment after rupture of the pocket so that the abutting faces are in a self-sealing position by a thin film of liquid remaining on the abutting faces after the liquid has been discharged from the pocket whereby the abutting faces serve as a non-return valve obstructing the passage of liquid and material to the open mouth, thereby retaining the contents during the mixing thereof by manipulation of the bag while the open mouth is still available for dispensing of the mixture as desired, said inner walls of the bag being subject to the inward pressure of the mixture if the bag is inverted to thereby hold the inner walls close together to facilitate the self-sealing position of the non-return valve.

17. A composite bag as defined in claim 15 wherein the opposed inner walls extend along the entire length of the top of the bag.

18. A composite bag as defined in claim 17 wherein the inner walls have end portions that are coextensive with the two sides of the outer periphery.

19. A composite bag as defined in claim 15 wherein the open mouth leading to the inner pocket is located along the top of the outer periphery.

20. A composite bag as defined in claim 15 wherein the inner pocket formed is adapted to hold a predetermined quantity of liquid.

21. A composite bag as defined in claim 20 wherein the inner pocket includes a restricting seam means to separate a usable, fillable portion of the pocket from a closed, unfillable portion of the pocket.

22. A composite bag as defined in claim 21 wherein the flexible waterproof film material is thermoplastic and the restricting seam means comprises a heat sealed portion extending from the top of the bag transversely across the inner pocket.

23. A composite bag as defined in claim 15 wherein the inner pocket includes a first pocket means located in a second pocket means that is larger than the first pocket means to form a double pocket arrangement.

* * * * *